US006632856B2

(12) United States Patent
Chen et al.

(10) Patent No.: US 6,632,856 B2
(45) Date of Patent: Oct. 14, 2003

(54) POLYURETHANE-FORMING BINDERS

(76) Inventors: Chia-hung Chen, 6308 Rockland Dr., Dublin, OH (US) 43017; Jorg Kroker, 355 Woodard Pl., Powell, OH (US) 43065

( * ) Notice: Subject to any disclaimer, the term of this patent is extended or adjusted under 35 U.S.C. 154(b) by 0 days.

(21) Appl. No.: 09/912,275

(22) Filed: Jul. 24, 2001

(65) Prior Publication Data

US 2003/0037904 A1 Feb. 27, 2003

(51) Int. Cl.[7] ..... B22C 1/00

(52) U.S. Cl. ..... 523/139; 523/142; 523/143; 523/147

(58) Field of Search ..... 523/139, 142, 523/143, 147

(56) References Cited

U.S. PATENT DOCUMENTS 4,469,517 A * 9/1984 Cooke, Jr. ..... 106/38.3
5,859,091 A * 1/1999 Chen et al. ..... 523/140
6,017,978 A 1/2000 Chen et al.
6,063,833 A * 5/2000 Chen et al. ..... 523/139
6,365,646 B1 * 4/2002 Laitar et al. ..... 523/143

FOREIGN PATENT DOCUMENTS

WO 01/41954 A1 6/2001 ..... B22C/1/22

* cited by examiner

*Primary Examiner*—Edward J. Cain

(57) ABSTRACT

This invention relates to a polyurethane-forming no-bake foundry binder comprising a (a) polyether polyol component comprising (1) a polyether polyol, (2) hydrofluoric acid, and (3) an aminoalkoxysilane, (b) a polyisocyanate component, (c) a liquid tertiary amine catalyst component. Foundry mixes are prepared by mixing the binder system with a foundry aggregate by a no-bake process. The resulting foundry shapes are used to cast metal parts from ferrous and non-ferrous metals.

13 Claims, No Drawings

POLYURETHANE-FORMING BINDERS

CROSS-REFERENCE TO RELATED APPLICATIONS

Not Applicable.

CLAIM TO PRIORITY

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION (1) Field of the Invention

This invention relates to a polyurethane-forming no-bake foundry binder comprising a (a) polyether polyol component comprising (1) a polyether polyol, (2) hydrofluoric acid, and (3) an aminoalkoxysilane, (b) a polyisocyanate component, (c) a liquid tertiary amine catalyst component. Foundry mixes are prepared by mixing the binder system with a foundry aggregate by a no-bake process. The resulting foundry shapes are used to cast metal parts from ferrous and non-ferrous metals.

(2) Description of the Related Art

One of the major processes used in the foundry industry for making metal parts is sand casting. In sand casting, disposable foundry shapes (usually characterized as molds and cores) are made by shaping and curing a foundry binder system that is a mixture of sand and an organic or inorganic binder. The binder is used to strengthen the molds and cores.

Two of the major processes used in sand casting for making molds and cores are the no-bake process and the cold-box process. In the no-bake process, a liquid curing agent is mixed with an aggregate and binder, and shaped to produce a cured mold and/or core. In the cold-box process, a gaseous curing agent is passed through a compacted shaped mix to produce a cured mold and/or core. Phenolic urethane binders, cured with a gaseous tertiary amine catalyst, are often used in the cold-box process to hold shaped foundry aggregate together as a mold or core. See for example U.S. Pat. No. 3,409,579. The phenolic urethane binder system usually consists of a phenolic resin component and polyisocyanate component which are mixed with sand prior to compacting and curing to form a foundry binder system. Because the foundry mix often sits unused for extended lengths of time, the binder used to prepare the foundry mix must not adversely affect the benchlife of the foundry mix.

Among other things, the binder must have a low viscosity, be gel-free, remain stable under use conditions, and cure efficiently. The cores and molds made with the binders must have adequate tensile strengths under normal and humid conditions, and release effectively from the pattern. Binders, which meet all of these requirements, are not easy to develop.

Because the cores and molds are often exposed to high temperatures and humid conditions, it also desirable that the foundry binders provide cores and molds that have a high degree of humidity resistance. This is particular important for foundry applications, where the core or mold is exposed to high humidity conditions, e.g. during hot and humid weather, or where the core or mold is subjected to an aqueous core-wash or mold coating application for improved casting quality.

Phenolic urethane cold-box and no-bake foundry binders often contain a silane coupling agent and/or aqueous hydrofluoric acid to improve humidity resistance. See for example U.S. Pat. No. 6,017,978. Although this patent covers the use of silanes in general, the examples utilize a ureido silane, which is preferred. The silane and hydrofluoric acid are typically added to the phenolic resin component of the binder.

However, a disadvantage of adding the silane and free aqueous hydrofluoric acid to phenolic urethane no-bake binders, is that the addition retards the chemical reaction, and thus increases the worktime of the foundry mix and the striptime of the core or mold. If a longer time is required for the sand mix to set, this negatively affects productivity.

All citations referred to under this description of the "Related Art" and in the "Detailed Description of the Invention" are expressly incorporated by reference.

BRIEF SUMMARY OF THE INVENTION

This invention relates to a polyurethane-forming no-bake binder comprising:

(a) a polyether polyol component comprising,
  (1) a polyether polyol,
  (2) a fluorinated acid, and
  (3) an aminoalkoxysilane, (b) a polyisocyanate component, and (c) a liquid amine curing catalyst.

Cores and molds made with the binders have excellent humidity resistance, and this is achieved without substantial adverse effects on the reactivity of the binder, i.e. the worktime of the foundry mix and the striptime of the core or mold from the pattern is not substantially increased. Thus, the use of these binders have an advantage not found when phenolic urethane having similar formulations are used as no-bake binders, since the worktime of foundry mixes made with phenolic urethane binders typically increases and the striptime also increases, when hydrofluoric acid and a silane are added to the binder. This improvement is significant because, if a longer time is required for the sand mix to set, this adversely affects productivity. These advantages are obtained without sacrificing other properties such as casting quality.

The invention also relates to the use of the binders in foundry mixes, core-making by the no-bake process, and in the casting of ferrous and non-ferrous metals.

BRIEF DESCRIPTION OF THE SEVERAL VIEWS OF THE DRAWINGS

Not Applicable.

DETAILED DESCRIPTION OF THE INVENTION

The detailed description and examples will illustrate specific embodiments of the invention will enable one skilled in the art to practice the invention, including the best mode. It is contemplated that many equivalent embodiments of the invention will be operable besides these specifically disclosed.

The aminoalkoxysilanes used in the binder composition typically have the following general formula:

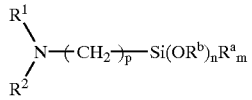

wherein:

(1) $R^1$ and $R^2$ are selected from the group consisting of H; alkyl groups, aryl groups, mixed alky-aryl groups, substituted alkyl groups, aryl groups; di- or triamino groups, amino alkyl groups, amino aryl groups, amino groups having mixed alky-aryl groups, and amino groups having substituted alkyl groups, aryl groups, mixed alky-aryl groups; and alkoxysilane groups, where $R^1$ and $R^2$ can be the same or different and preferably where at least one of the $R_1$ and $R_2$ groups is H, and the other group is an unsubstituted alkyl group having 1–4 carbon atoms;

(2) n is a whole number from 1 to 3, preferably where $n \geqq 1$;

(3) n+m=3;

(4) p is a whole number from 1 to 5, preferably 2 to 3, and (5) $R^a$ and $R^b$ are selected from the group consisting of alkyl groups, aryl groups, mixed alky-aryl groups, substituted alkyl groups, aryl groups, preferably an unsubstituted alkyl group having from 1–carbon atoms, and can be identical or different.

This structure does not include ureido silanes, which do not work effectively for purposes of this invention.

Specific examples of aminoalkoxysilanes include 3-aminopropyldimethyl-methoxysilane, 3-aminopropyltrimethoxysilane, 3-aminopropyltriethoxysilane, 3-aminopropylmethyl-dimethoxysilane 3-aminopropylmethyl-diethoxysilane, N-(n-butyl)-3-aminopropyl-trimethoxysilane, N-aminoethyl-3-aminopropylmethyl-dimethoxysilane, 3-ureidopropyltrimethoxysilane, 3-ureidopropyltriethoxysilane, N-phenyl-3-aminopropyltrimethoxysilane, N-[(N'-2-aminoethyl)-2-aminoethyl)]-3-aminopropyltrimethoxysilane and bis (3-trimethoxysilylpropyl) amine. Preferably used as the aminoalkoxysilanes are aminoalkoxysilanes where $R^1$ and $R^2$ are selected from the group consisting of H; alkyl groups, aryl groups, substituted alkyl groups, aryl groups, mixed alky-aryl groups; di- or triamino groups, amino alkyl groups, amino aryl groups, amino groups having mixed alky-aryl groups, and amino groups having substituted alkyl groups, aryl groups, mixed alky-aryl groups; and alkylsilanol groups, preferably where at least one of the $R_1$ and $R_2$ groups is H and the other group is an unsubstituted alkyl group having 1–4 carbon atoms.

The polyether polyol component comprises a polyether polyol. The polyether polyols, which are used in the polyurethane-forming foundry binders are liquid polyether polyols or blends of liquid polyether polyols typically having a hydroxyl number of from about 200 to about 1000, preferably about 300 to about 800 milligrams of KOH based upon one gram of polyether polyol. The viscosity of the polyether polyol is typically from 100 to 1000, centipoise, preferably from 200 to 700 centipoise, most preferably 250 to 600 centipoise. The polyether polyols may have primary and/or secondary hydroxyl groups.

These polyols are commercially available and their method of preparation and determining their hydroxyl value is well known. The polyether polyols are prepared by reacting an alkylene oxide with a polyhydric alcohol in the presence of an appropriate catalyst such as sodium methoxide according to methods well known in the art. Any suitable alkylene oxide or mixtures of alkylene oxides may be reacted with the polyhydric alcohol to prepare the polyether polyols. The alkylene oxides used to prepare the polyether polyols typically have from two to six carbon atoms. Representative examples include ethylene oxide, propylene oxide, butylene oxide, amylone oxide, styrene oxide, or mixtures thereof. The polyhydric alcohols typically used to prepare the polyether polyols generally have a functionality greater than 2.0, preferably from 2.5 to 5.0, most preferably from 2.5 to 4.5. Examples include ethylene glycol, diethylene glycol, propylene glycol, trimethylol propane, and glycerine.

Although not necessarily preferred or required, the polyether polyol component may contain solvents.

The polyether polyol component may also contain other polyols, particularly aliphatic, and/or preferably aromatic polyester polyols. The aromatic polyester polyols, or a blend of liquid aromatic polyester polyols, typically have a hydroxyl number from about 200 to 2,000, preferably from 200 to 1200, and most preferably from 250 to 800; a functionality equal to or greater than 2.0, preferably from 2 to 4; and a viscosity of 500 to 50,000 centipoise at 25° C., preferably 1,000 to 35,000, and most preferably 1,500 to 25,000 centipoise. They are typically prepared by ester interchange of aromatic ester and alcohols or glycols by an acidic catalyst. The amount of the aromatic polyester polyol in the polyol component is typically from 2 to 65 weight percent, preferably from 10 to 50 weight percent, most preferably from 10 to 40 weight percent based upon the polyol component. Examples of aromatic esters used to prepare the aromatic polyesters include phthalic anhydride and polyethylene terephthalate. Examples of alcohols used to prepare the aromatic polyesters are ethylene glycol, diethylene glycol, triethylene glycol, 1,3-propane diol, 1,4-butane diol, dipropylene glycol, tripropylene glycol, tetraethylene glycol, glycerin, and mixtures thereof. Examples of commercially available aromatic polyester polyols are STEPANPOL polyols manufactured by Stepan Company, TERATE polyol manufactured by KOSA, THANOL aromatic polyol manufactured by Eastman Chemical, and TEROL polyols manufactured by Oxide Inc.

Although not necessarily preferred, phenolic resins, e.g. novolac resins and phenolic resole resins, and/or amine-based polyols can be added to the polyol component. If a phenolic resin is added to the polyether polyol, the preferred phenolic resins used are benzylic ether phenolic resins which are specifically described in U.S. Pat. No. 3,485,797 which is hereby incorporated by reference into this disclosure.

The polyisocyanate component of the binder typically comprises a polyisocyanate and organic solvent. The polyisocyanate has a functionality of two or more, preferably 2 to 5. It may be aliphatic, cycloaliphatic, aromatic, or a hybrid polyisocyanate. Mixtures of such polyisocyanates may be used. Also, it is contemplated that chemically modified polyisocyanates, prepolymers of polyisocyanates, and quasi prepolymers of polyisocyanates can be used. Optional ingredients such as release agents may also be used in the polyisocyanate hardener component.

Representative examples of polyisocyanates which can be used are aliphatic polyisocyanates such as hexamethylene diisocyanate, alicyclic polyisocyanates such as 4,4'-dicyclohexylmethane diisocyanate, and aromatic polyisocyanates such as 2,4'- and 2,6-toluene diisocyanate, diphenylmethane diisocyanate, and dimethyl derivatives thereof. Other examples of suitable polyisocyanates are 1,5-naphthalene diisocyanate, triphenylmethane triisocyanate, xylylene diisocyanate, and the methyl derivatives thereof, polymethylenepolyphenyl isocyanates, chlorophenylene-2, 4-diisocyanate, and the like.

The polyisocyanates are used in sufficient concentrations to cause the curing of the phenolic resin when catalyzed with the tertiary amine curing catalyst. In general the isocyanato group ratio of the polyisocyanate component to the hydroxyl groups of the polyether polyol component is from 1.25:1 to 1:1.25, preferably about 1:1. The polyisocyanate is used in a liquid form. Solid or viscous polyisocyanates must be used in the form of organic solvent solutions. In general, the solvent concentration will be in the range of up to 80% by weight of the resin solution and preferably in the range of 20% to 80%.

Those skilled in the art will know how to select specific solvents for the polyisocyanate component. Non polar solvents, e.g. aromatic solvents, are useful because they are compatible with the polyisocyanate. Examples of aromatic solvents include xylene and ethylbenzene. The aromatic solvents are preferably a mixture of aromatic solvents that have a boiling point range of 125° C. to 250° C.

The solvent component can include drying oils such as disclosed in U.S. Pat. No. 4,268,425. Such drying oils include glycerides of fatty acids which contain two or more double bonds. Also, esters of ethylenically unsaturated fatty acids such as tall oil esters of polyhydric alcohols or monohydric alcohols can be employed as the drying oil. In addition, the binder may include liquid dialkyl esters such as dialkyl phthalate of the type disclosed in U.S. Pat. No. 3,905,934 such as dimethyl glutarate, dimethyl adipate, dimethyl succinate; and mixtures of such esters.

Although not required when the aminoalkoxysilanes of this invention, the binder may also contain a silane (typically added to the polyol component) having the following general formula:

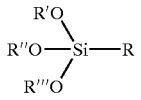

wherein R', R" and R'" are hydrocarbon radicals and preferably an alkyl radical of 1 to 6 carbon atoms and R is an alkyl radical, an alkoxy-substituted alkyl radical, and can be identical or different. The silane is preferably added to the phenolic resin component in amounts of 0.01 to 5 weight percent, preferably 0.1 to 1.0 weight percent based on the weight of the phenolic resin component.

When preparing an ordinary sand-type foundry shape, the aggregate employed has a particle size large enough to provide sufficient porosity in the foundry shape to permit escape of volatiles from the shape during the casting operation. The term "ordinary sand-type foundry shapes," as used herein, refers to foundry shapes which have sufficient porosity to permit escape of volatiles from it during the casting operation.

The preferred aggregate employed for ordinary foundry shapes is silica wherein at least about 70 weight percent and preferably at least about 85 weight percent of the sand is silica. Other suitable aggregate materials include zircon, olivine, aluminosilicate sand, chromite sand, and the like. Although the aggregate employed is preferably dry, it can contain minor amounts of moisture.

In molding compositions, the aggregate constitutes the major constituent and the binder constitutes a relatively minor amount. In ordinary sand type foundry applications, the amount of binder is generally no greater than about 10% by weight and frequently within the range of about 0.5% to about 7% by weight based upon the weight of the aggregate. Most often, the binder content ranges from about 0.6% to about 5% by weight based upon the weight of the aggregate in ordinary sand-type foundry shapes.

The binder compositions are preferably made available as a three-part system with the polyether polyol component as one part (Part I), and the polyisocyanate component as the other part (Part II), and the catalyst as the third part (Part III). Usually, the polyether polyol component is first mixed with sand and catalyst, and then the polyisocyanate component is added. Methods of distributing the binder on the aggregate particles are well-known to those skilled in the art.

The foundry binder system is molded into the desired shape, such as a mold or core, and cured. Curing by the no-bake process takes place by mixing a liquid amine curing catalyst into the foundry binder system, shaping it, and allowing it to cure, as described in U.S. Pat. No. 3,676,392. Useful liquid amines have a $pK_b$ value generally in the range of about 5 to about 11. Specific examples of such amines include 4-alkyl pyridines, isoquinoline, arylpyridines, 1-vinylimidazole, 1-methylimidazole, 1-methylbenzimidazole, and 1,4-thiazine. Preferably used as the liquid tertiary amine catalyst is an aliphatic tertiary amine, particularly (3-dimethylamino)propylamine. In general, the concentration of the liquid amine catalyst will range from about 0.2 to about 10.0 percent by weight of the phenolic resin, preferably 1.0 percent by weight to 4.0 percent by weight, most preferably 2.0 percent by weight to 5.0 percent by weight based upon the weight of the polyether polyol component.

The following abbreviations and components are used in the Examples:

ABBREVIATIONS

The following abbreviations are used:

| | |
|---|---|
| A-1160 | an ureido as a solution of 50% in methanol, manufactured by OSi Specialties in a solution, a business of Crompton Corporation. |
| A-2120 | aminoethyl aminopropyl methyl dimethoxysilane, an aminoalkoxysilane, manufactured by Osi Specialties a business of Crompton Corporation. |
| BOS | based on sand. |
| CATALYST | no-bake catalyst comprising tris (3-dimethylamino) propylamine in dipropylene glycol. |
| HF | hydrofluoric acid, 49% by weight in water. |
| Part I | a polyol component comprising approximately equal amounts of a polyether polyol having a hydroxyl value of about 400 to 500, a glycol, and an aromatic polyester polyol having a hydroxyl value of about 200 to 300, where said parts are based on the total weight of the Part I. |
| Part II | a polymeric isocyanate component comprising polymeric diphenylmethylene diisocyanate having a functionality of about 2.5 to 2.7. |
| % RH | relative humidity %. |
| ST | striptime, used in connection with the no-bake process for core/mold-making, is defined as the time elapsed between mixing the binder components and the sand and placing the sand mix in a pattern, and when the foundry shape reaches a level of 90 on the Green Hardness "B" Scale Gauge sold by Harry W. Dietert Co., Detroit, Michigan. |

-continued

| | |
|---|---|
| WT | worktime, used in connection with the no-bake process for core-making, is defined as the time elapsed between mixing the binder components and when the foundry shape reaches a level of 60 on the Green Hardness "B" Scale Gauge sold by Harry W. Dietert Co., Detroit, Michigan. |

EXAMPLES

While the invention has been described with reference to preferred embodiments, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is not intended that the invention be limited to the particular embodiments disclosed herein, but that the invention will include all embodiments falling within the scope of the appended claims. All amounts and percentages are by weight, unless otherwise expressly indicated.

Example 1

Comparison Test of Binders in Core-Making Using an Aminoalkoxysilane and Ureido Silane In these examples, a three-component polyurethane-forming no-bake foundry binder, comprising the polyol component, polyisocyanate component, and catalyst component, is used. Example A is a control and does not contain HF or a silane. Example B is a comparison example, which contains 0.15 weight percent HF and 0.5 weight percent of ureido silane (A-1160). Example 1 contains 0.15 weight percent HF and 0.5 weight percent of an aminoalkoxysilane (A-2120), a silane within the scope of this invention, in the Part I.

Several test cores were prepared with the binders. The Part I and CATALYST (3.5 weight percent based on the polyol component) were mixed with Wedron 540 silica sand, and then the Part II was added. The weight ratio of Part I to Part II was 47/53 and the binder level was 1.2% by weight BOS. The resulting foundry mix is forced into a dogbone-shaped corebox and the tensile strengths of the test specimen ("dog bone") were measured using the standard procedure, ASTM#329-87-S, known as the "Briquette Method".

The tensile strengths of the test cores made according to the examples were measured on a Thwing Albert Intellect II instrument. Tensile strengths of test cores made with the sand mixes were measured 30 minutes, 1 hour, and 3, hours, and 24 hours after removing them from the corebox. In order to check the resistance of the test cores to degradation by humidity, some of the test cores were stored in a humidity chamber for 24 hours at a humidity of 90 percent relative humidity before measuring the tensile strengths. Measuring the tensile strength of the test core enables one to predict how the mixture of sand and polyurethane-forming binder will work in actual foundry operations. Lower tensile strengths for the test cores indicate inferior binder performance.

The WT was also measured for the sand mixes used to prepare the cores, and the ST was measured when the cores were removed from the pattern.

| Example | Control | A | 1 |
|---|---|---|---|
| WT/ST (min) | 6:25/10:25 | 5:30/9:30 | 5:30/8:25 |
| Tensile Development (psi) | | | |
| 30 min. | 80 | 125 | 123 |
| 1 hr. | 189 | 177 | 220 |
| 3 hrs. | 204 | 187 | 257 |
| 24 hrs. | 262 | 235 | 271 |
| 24 hrs. + 90% RH | 50 | 49 | 119 |

The data in Table I indicate that the cores produced from the binder of Example 1 showed far superior humidity resistance (values in bold face) than the cores produced from the binders of Examples A which contained the ureido silane. This is achieved without any increase in worktime or striptime. This is important because the improvement in humidity resistance is achieved without adversely affecting productivity.

We claim:

1. A no-bake foundry binder system comprising:

(a) a polyol component comprising, (1) a polyether polyol prepared by the reaction of an alkylene oxide with a polyhydric alcohol, (2) a fluorinated acid, and (3) an aminoalkoxysilane, (b) a polyisocyanate component, (c) a no-bake liquid tertiary amine catalyst component.

2. The foundry binder system of claim 1 wherein the fluorinated acid is hydroflouric acid.

3. The foundry binder of claim 2 wherein the polyether polyol has a hydroxyl number from 200 to 1000.

4. The foundry binder of claim 3 wherein the polyol component comprises an aromatic polyester polyol in addition to the polyether polyol.

5. The foundry binder system of claim 4 wherein the NCO content of the polyisocyanate component is from 12% to 33%.

6. The foundry binder system of claim 5 wherein the ratio of hydroxyl groups of the polyol component to the polyisocyanate groups of the polyisocyanate component is from 1.25:1.0 to 1.0:1.25.

7. The foundry binder system of claim 6 wherein the amount of hydrofluoric acid is from 0.05 weight percent to 1.0 weight percent, the amount of aminoalkoxysilane is from 0.1 weight percent to 1.0 weight percent, and the amount of catalyst is from 1.0 to 6.0 weight percent, where said weight percents are based upon the weight percent of the polyol component.

8. The foundry binder system of claim 7 wherein the aminoalkoxysilane is aminoethylamniopropyl methyl dimethoxysilane).

9. The foundry binder of claim 8 wherein the catalyst is tris (3-dimethylamino) propylamine.

10. A foundry mix comprising:

A. a major amount of an untreated aggregate; and

B. an effective bonding amount of the binder system of claim 1, 2, 3, 4, 5, 6, 7, 8, or 9.

11. A no-bake process for preparing a foundry shape which comprises:

(a) forming a foundry mix as set forth in claim 10;

(b) forming a foundry shape by introducing the foundry mix obtained from step (a) into a pattern; and (c) removing the foundry shape of step (b) from the pattern.

12. The process of claim 11 wherein the amount of said binder composition is about 0.5 percent to about 7.0 percent based upon the weight of the aggregate.

13. The process of casting a metal which comprises:

(a) preparing a foundry shape in accordance with claim 12;

(b) pouring said metal while in the liquid state into and a round said shape;

(c) allowing said metal to cool and solidify; and (d) then separating the molded article.

* * * * *